United States Patent [19]

Leibovich

[11] Patent Number: 4,837,497

[45] Date of Patent: Jun. 6, 1989

[54] VARIABLE TRANSFORMER, REACTOR AND METHOD OF THEIR CONTROL

[76] Inventor: Gregory Leibovich, 2218 Ardemore Dr., Fullerton, Calif. 92633

[21] Appl. No.: 138,958

[22] Filed: Dec. 29, 1987

[51] Int. Cl.[4] ..... G05F 3/04

[52] U.S. Cl. ..... 323/345; 323/247; 323/254; 323/334; 336/12; 336/143; 336/147; 336/155

[58] Field of Search ..... 323/247, 328, 254, 331, 323/334, 339, 345; 336/10, 12, 143, 147, 155, 184

[56] References Cited

U.S. PATENT DOCUMENTS

| | | | |
|---|---|---|---|
| 2,089,860 | 8/1937 | Rypinski | 323/334 |
| 2,363,881 | 11/1944 | Lord | 323/331 |
| 4,547,721 | 10/1985 | Drapp | 336/147 |
| 4,678,986 | 7/1987 | Barthelemy | 323/345 |

FOREIGN PATENT DOCUMENTS

| | | | |
|---|---|---|---|
| 1096708 | 6/1984 | U.S.S.R. | 323/247 |

*Primary Examiner*—William H. Beha, Jr.

[57] ABSTRACT

A variable transformer, reactor having a core combining at least two complete core elements wiht a common yoke; primary winding divided into two independently fed sets of phase coils wound in opposite direction, arranged on symmetrical legs of core elements and separated by the common yoke; secondary winding with each phase coil divided into two wound in opposite direction portions carried by symmetrical core legs, adjacent to the primary coils and separated by common yoke. The secondary short-circuited reactor winding is reduced to at least one close loop member with loop portions separated by the common yoke. The single, polyphase apparatus has at least one primary coil per set that includes a controllable device in circuit relation therewith to enable control of one primary coil relative to the other, either in current magntidue or in current phase shift. The controllable device being either a silicon control rectifier, triac or transistor. By continuous control of the controllable device an apparatus variable output parameters are obtained.

37 Claims, 4 Drawing Sheets

VARIABLE TRANSFORMER, REACTOR AND METHOD OF THEIR CONTROL

FIELD OF THE INVENTION

This invention relates to the transformers, reactors and, particularly, to the variable single and polyphase transformers, reactors and apparatuses for the control thereof.

DESCRIPTION OF THE PRIOR ART

Variable transformers, reactors have existed for many decades and found application in wide variety of static electromagnetic apparatuses. This class of apparatuses has several major groups presented by autotransformers with sliding contacts, autotransformers with multitap windings, linear and rotary transformers with variable air gap or flux linkage. The variable reactors may be divided into two main categories: the saturable reactors and reactors with variable air gap. The devices of this class, despite their longevity and wide application, are not free from setbacks. The development of modern control means, particularly SCR's, did not result in any new group of variable electromagnetic apparatuses fully utilizing SCR's potential. The apparatuses of the present invention are intended to reduce drawbacks typical for existing devices and provide enhanced susceptibility, flexibility and response to phase control employing SCR's. The following brief description of existing variable transformers and reactors underlines their setbacks in comparison with apparatuses of the present invention.

The single and, polyphase autotransformers were widely used, and they are still utilized, in low power range as laboratory transformers or variacs. They provide full range of discrete, small increments voltage control. However, the sliding, causing sparks, brush contact and the bare wire elements, lacking the isolation between primary and secondary circuits, limit this device application to low voltage, low current apparatus, further restricted by environmental requirements. Besides, the complexity of a core, windings configuration, current carrying movable contact and its servodrive, circuit elements eliminating short-circuited turns under the brush, maintain high cost for this group of slow response transformers.

The variable transformer and autotransformer for high power application are built with multiple taps on the secondary winding. This group of apparatuses allows step control of the secondary voltage and imposes strict requirements on voltage adjustment under the load. The switching is realized by means of expensive switches and balancing reactors.

Transformers with relative displacement of primary and secondary windings or variable flux linkage devices originally found limited application as induction regulators. However, the complexity of apparatus, which is virtually wound rotor induction machine, its heavy, voluminous servodrive and unit high total cost, practically eliminated apparatus application in the last decades.

The variable gap welding transformer originally found wide application inspite of its setbacks: rigid electormechanical drive for controlling the air gap, large forces, vibrations and current limiter in the primary winding. The development of the solid state voltage regulators led to curtailing of this type of transformers as well as induction regulators, at the industry demand.

The development of SCR's and power transistors have expanded the application of single and polyphase non-variable transformers with fixed secondary voltage. The control functions were overtaken by solid state regulators and realized through continuous adjustments of SCR's firing angle, defining the voltage across the load and its current. However, the application of SCR's did not necessarily simplify the structure of any type of transformers. The powerfull rectifier transformers have two three phase system secondary windings with a balancing reactor between neutral points, to correct assymetry of the secondary currents and to reduce a level of distortion imposed on a network. The direct current components of the rectified current magnetized the transformer core, causing additional assymetry. the other type of transformer, widespread in last decade, is a device with a split bobbin or two legs, primary winding transformer, which became a major element of numerous invertors, frequency converters and d.c. to d.c. convertors. Nevertheless, the waveform of output voltage requires the correction by additional circuit reactive elements: reactors, chokes or filters.

The variable reactor found application in two major categories. The variable air gap reactor employs electromechanical or hydraulic drives to adjust a length of the air gap and, consequently, to adjust a reactance of the apparatus. The slow response servodrives overcome large forces and vibration of loaded devices limiting their application.

The widely used saturable reactors also are not free from setbacks. The direct current coil, carried by a central leg of the core, establishes the variable flux density constant field, imposed on the a.c. magnetic field induced by a.c. windings. These windings carried by the outside core legs are connected in series to minimize magnetic flux density assymetry, taking place every half cycle in the outside core legs. The central core leg is eliminated from a.c. magnetic circuit, reducing a total core utilization. the control of d.c. field requires variable d.c. power supply, capable to withstand high voltage induced in d.c. coil by apparatus transients and flux pulsation in the central leg of the core.

SUMMARY OF THE INVENTION

The apparatuses of the present invention form a group of devices with constant magnetic parameters solid cores. The primary control function is performed by a solid state control. However, the structure of the core, the mutual arrangement of primary windings and a secondary winding configuration give the apparatus additional control properties. They are similar to the properties of devices with variable flux linkage of the secondary winding, like variable air gap transformer or induction regulator. The secondary control function is achieved through a variable flux distribution pattern in the core elements. Therefore, the transformers and reactors of the invention combine advantages of all existing devices.

They provide stepless smooth control of output parameters without sliding, moving contacts. The apparatuses obviate any necessity in servomechanism for controlling the position of sliding contacts, changing air gap or relative position of primary and secondary windings. The apparatuses require no switches for selecting the taps, balancing the reactors nor taps in the secondary winding.

The voltage and current waveform are almost free of distortion unlike the transformers with SCR's in the secondary windings for voltage control. The high gain a.c. voltage control reduces current and flux d.c. components, core magnetization, level of distortion in the network, thus eliminating power conditioners, surge suppressors, reactors, chokes and filters. The primary and secondary windings of the transformers are electrically isolated, unlike autotransformers. They carry out functions of isolation transformers with enhanced safety features due to the phase control applied to primary windings.

The necessity to control only a fraction of energy delivered to the apparatus allows to scale down current characteristics of components and to simplify control, thus resulting in reduced size, weight and cost of control panel. The reliable, flexible, high response control enables the apparatus application in closed loop control systems.

The single phase transformer, reactor has two primary and one secondary winding carried by a core of special configuration, which is shaped to provide two independent magnetic circuits for each primary coil. The magnetic fluxes induced by two primary coils link only one split bobbin, two legs secondary coil. Each leg of the secondary winding is installed next to the primary coil on the same core leg and interacts with this primary coil only at symmetrical flux distribution pattern in the core elements. The same leg of he secondary winding is linked by magnetic flux of the other primary coil when magnetic flux pattern in the core elements becomes assymetrical. The level of assymetry is controlled through an adjustment of firing angle of SCR's, triacs or transistors included in at least one primary coil. Two extreme conditions characterize the secondary voltage.

The SCR's firing angle is zero. Both primary coils carry full currents of equal phase and amplitude. The secondary winding voltage is maximum.

Only one primary coil is energized. The SCR's firing angle is 180° allowing no current through the second primary winding. The voltage induced in the first leg of secondary winding is nominal. However, its other leg, sharing core with deenergized primary coil, received reduced flux of opposite polarity. This flux induces reduced and reversed polarity E.M.F.. The compound E.M. F. of secondary winding drops down to three times for no load conditions, and down to fifteen times for short circuit conditions.

The reversing of the primary coil with non-conducting triac has no effect on the output voltage. The following decrease of firing angle leads to further decrease of output voltage. The firing angle, close to zero, results in zero output of the secondary voltage. Under these conditions the transformer core legs carry equal fluxes of similar polarity, inducing equal E.M.F. of opposite polarity in the elements of secondary winding. Therefore, the compound E.M.F. of the secondary winding is zero.

The second alternative to expand a range of control consists of SCR's, triacs, transistors included in both primary windings and conducting at full secondary voltage. When SCR's in one primary winding are not conducting, the firing angle is close to 180°, the control function is transferred to the SCR's of the second primary winding, maintaining a zero firing angle through the first zone of control. Now the firing angle of these SCR's becomes a variable parameter and changes from zero to a value, adequate to the zero secondary voltage. The range of control expands from 70–80% to 100% with this circuit configuration. Yet with this double zone control, the apparatus still have significantly low level of distortions in the line and load, reduced amount of losses in the transformer and load caused by high order harmonics.

The single phase reactor structure is different from transformer only by a short-circuited secondary winding consisting of at least one turn closed loop of conductor. The loop has two portions separated by a common core yoke and installed adjacent to the primary coils carried by core legs. When both primary coils carry full current, firing angle zero, the reactor has minimum reactance and impedance due to the secondary maximum voltage, current and demagnetizing flux.

The other extreme conditions take place when semiconductor power switch included in one primary coil is not conducting, its firing angle is 180°. The voltage of secondary loop, its current and demagnetizing flux are minimum. The magnetic circuit of energized primary coil has minimum relactance and maximum flux, resulting in maximum self E.M.F. The reactor reactance and impedance have values almost seven times higher than these parameters at the other extreme conditions. The variation of reactor impedance might be expanded by selection of core magnetic parameters and by referring to the second zone of control. The second zone of control is accomplished by reversing one primary coil or by including power semiconductor switches in the second primary winding.

the three phase apparatus have at least two groups of three phase primary coils and one group of three secondary coils connected as wye or delta for transformer and short circuited on themself for reactor.

By selectively controlling the phase shift or the magnitude of the current in one group of primary windings relative to another, the apparatus may be readily controlled. Smooth control of the secondary voltage or reactor impedance may be effected by the use of silicon controlled rectifiers, triacs or power transistors connected in the phases of one group or both groups of primary windings. The firing of SCR's may be selectively controlled to effect relative shift of the phase, phase and magnitude, or magnitude of the currents in the set of primary windings controlled through such SCR's.

Other features and advantages will be better understood from a reading of the specification, when taken in conjunction with the accompanying drawings, in which like reference numerals refer to like elements in the several views.

DESCRIPTION OF THE PREFERRED EMBODIMENT

In accordance with the present invention, there are shown and described a transformer, reactor having at least two primary coils supplying magnetic flux to one secondary coil, consisting of two separated reversed portions.

The apparatus, due to its core special configuration and windings arrangement, possesses physical property to change flux distribution pattern in response to relative phase shift, phase and magnitude shift or magnitude change of currents in its primary coils. This variable core flux distribution effects energy received by the secondary winding, its e.m.f., current and flux and energy recovered back to the primary coils and mains.

It will become obvious how the variable energy distribution enhances apparatus response to the phase control enabling the apparatus to achieve wide range of performance parameters variation through controlling only a fraction of energy flow to the apparatus. It will be also shown and described why an enhanced susceptibility , low cost and weight, small size efficient phase control are accompanied by a low level of distortions in the mains, apparatus and load.

Figure 1:
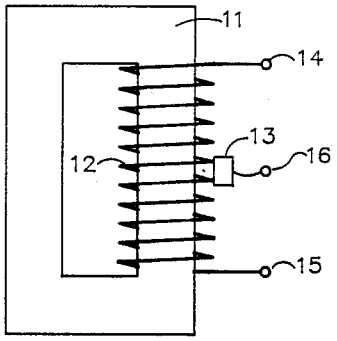
FIG. 1 (PRIOR ART)
FIG. 1 is an autotransformer variac diagram showing a winding, core arrangement.

The conventional autotransformer, variac, is presented in the FIG. 1. The core 11 carries winding 12. Every turn of the winding along a path of a reciprocal motion of brush 13 has an element without insulating. These bare elements of the turns provide sustained electrical contact between the coil and the brush. The secondary voltage is taken from the terminals 14 and 16, with primary voltage applied across terminals 14, 15. The secondary voltage is a function of the brush position, which is changed manually or by servodrive. The brush also serves as a short-circuiting element between adjacent turns covered by brush span, causing the arcs when brush is moved under the load. There is a possibility to have full line voltage impressed across the secondary circuit. These setbacks impose strict environmental restrictions on variac application, further restricted by its slow response unsuitable for closed control systems.

Figure 2:
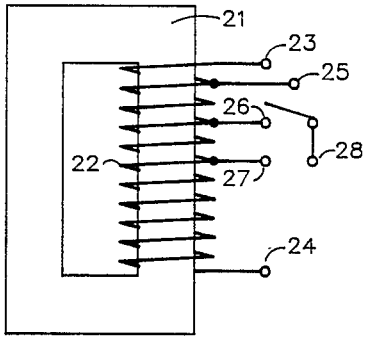
FIG. 2 (PRIOR ART)
FIG. 2 is a multitap autotransformer diagram showing a winding, core arrangement.

A transformer for a discrete step control of transformation ratio and, consequently, a secondary voltage is shown in FIG. 2. The core 21 carries winding 22 with taps 25, 26, 27 which number and location are determined by the range of voltage control and its increments. The switch 28 provides selective switching of output voltage under the load or with primary winding disconnected. The transition of powerful transformers in large capacity energy systems from one step voltage to the other must be performed without interruption of power supply, under the load. This transition between taps is accomplished by employing two selector switches, two disconnect switches, or replacing, an array of power semiconductor switches and a two legs center tap balancing reactor, not shown in the FIG. 2. The switching apparatus, providing only step voltage control, significantly effects transformer complexity, dependability and cost.

Figure 3:
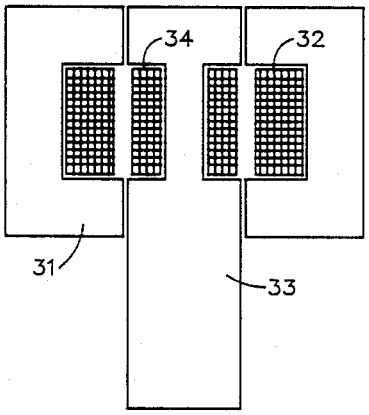
FIG. 3 (PRIOR ART)
FIG. 3 is a cross section of a transformer with adjustible position of the secondary winding.

The simplified modification of linear induction regulator is shown in the FIG. 3. The fixed core 31 accomodates primary coil 32. The movable core 33 carries secondary coil 34 with flexible leads connected to the output terminals. At the mutual position of primary and secondary coils shown in the FIG. 3, the maximum voltage appears at the secondary coil terminals. As a servomechanism changes position of the core 33, the secondary coil 34 is removed from primary magnetic circuit and its flux doesn't link secondary coil. The secondary voltage drops and reaches zero as core displacement approaches maximum. The induction regulators found most application as a rotary phase shifting apparatuses, which are similar to the wound rotor induction machines. The rotary, linear induction regulators are exposed to the high forces and vibration requiring a rigid servomechanizm, hardly buildible into the closed control systems.

Figure 4:
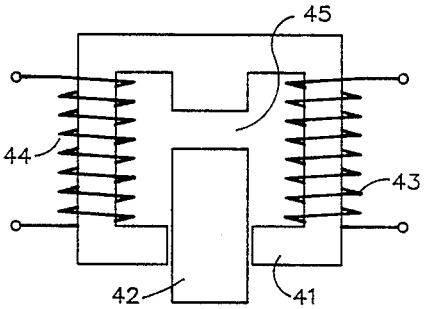
FIG. 4 (PRIOR ART)
FIG. 4 is a variable air gap reactor diagram showing windings, core arrangement.

The reactor with variable air gap is shown in the FIG. 4. The stationary core 41 and movable core 42 form a magnetic circuit closed through the air gap 45. The stationary core 41 carries coils 43, 44 connected in series to direct their opposing magnetic fluxes through the stationary core and variable air gap. The position of the core 42 determines the air gap 45 length, reactor reactance and impedance. The moving core of the reactor is a subject to high force and vibration impeding apparatus application in control systems with fast response.

Figure 5:
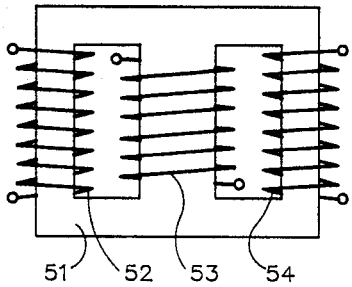
FIG. 5 (PRIOR ART)
FIG. 5 is a saturable reactor diagram showing windings, core arrangement.

A saturable reactor is shown in the FIG. 5. It has a closed core 51 carrying a.c. coils 52 and 54. The d.c. coil 53 is placed on the core center leg with cross section equal to the sum of cross section of the outer core legs. This ratio provides a minimum reluctance magnetic circuit for d.c. flux and enhances efficiency of control. By varying the control d.c. current, the core is magnetized up to different levels, thereby varying the effective reactance of apparatus and, consequently, the precise current regulation. The duplicate a.c. coils 52, 53 are connected in parralel aiding. However, the fluxes in each outer leg are not symmetrical at every half of the cycle causing assymetry and distortion of currents in the circuit at high level of d.c. flux. The disadvantages of the saturable reactor are, also, a narrow range of control, a special d.c. control winding and its power supply, a voluminous, providing only d.c. flux, center leg excluded from a.c. magnetic circuits limiting thereby a reactance of the apparatus.

Figure 6:
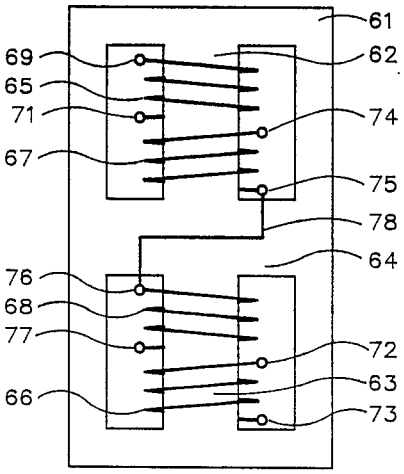
FIG. 6 is a transformer of the present invention diagram showing windings arrangement and core configuration
Figure 8:
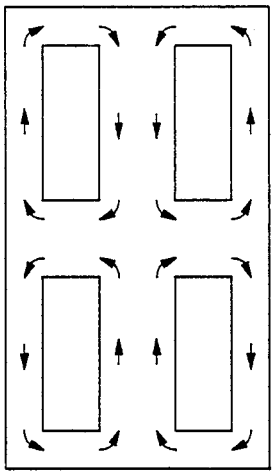
FIG. 8 is a diagrammatic representation of the core magnetic flux path in device of the present invention when both primary coils carry equal phase and magnitude currents.
Figure 9:
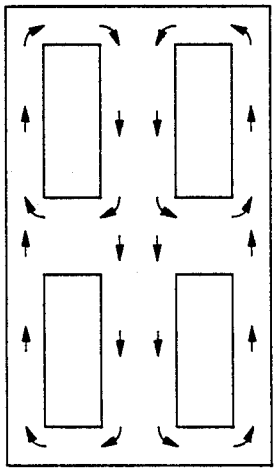
FIG. 9 is a diagrammatic representation of the core magnetic flux path in device of the present invention when one primary coil is energized.
Figure 10:
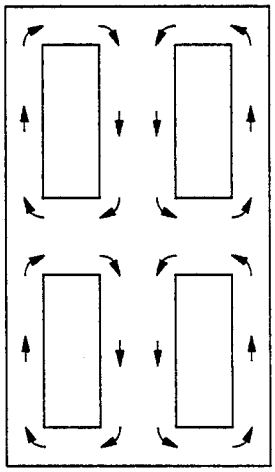
FIG. 10 is a diagrammatic representation of the core magnetic flux path in device of the present invention when primary coils carry equal currents shifted 180°.

The variable transformer of present invention is shown in the FIG. 6. The outside core frame 61 is a back iron for two central legs 62, 63, separated by the common yoke 64. The leg 62 carries a primary winding 65 and a half of the secondary winding 67. The leg 63 carries a primary winding 66 and the second half of the secondary winding 68. The portions of the compound secondary winding 67 and 68 are wound in an opposite direction and connected in series through their terminal 75, 76 by jumper 78, forming a secondary winding common for both primaries. The primary windings, 65, 66 are also the opposite direction and connected in parallel with the line through the terminals 69, 72 and 71, 73. When the primary windings are connected as described, their fluxes are opposing each other with the flux pattern shown in the FIG. 8. The same flux pattern will be maintained when one of the primary windings is supplied through SCR's, triac, and when their firing angle is 0. The flux distribution pattern shown in the FIG. 9 happens when one of the primary windings is deenergized or SCR's, triac included into this winding circuit are not conducting, firing angle is 180°. The magnetic flux through the secondary winding portion, adjacent to the demagnetized primary coil, changes its polarity and induces the e.m.f. reduced magnitude and an opposite polarity to the e.m.f., induced in the other portion of the secondary winding. The total secondary winding e.m.f. is compounded of its components induced in both winding portions. The resultant secondary winding current creates a flux causing further total e.m.f. reduction. In order to expand a range of voltage control, the primary winding supplied through SCR's, triac should be reversed at the non-conducting solid state devices. The gradual change of SCR's firing angle from 180° to 0° will result in flux distribution pattern shown in the FIG. 10. The total flux through the secondary winding and its e.m.f. will equal zero, due to equal magnitude and the opposite polarity e.m.f. components induced in the secondary winding portions.

Figure 7:
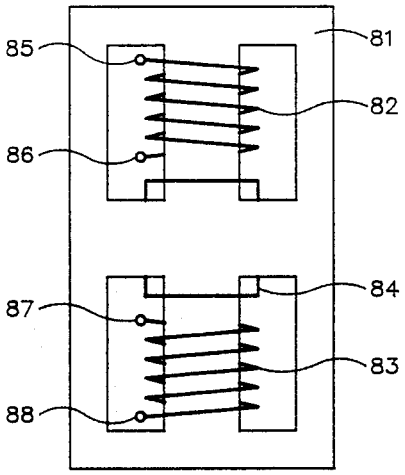
FIG. 7 is a reactor of the present invention diagram showing windings arrangement and core configuration.

The single phase reactor is shown in the FIG. 7. The flux pattern distribution of reactor is similar to the transformer. The core 81 carries primary windings 82, 83 connected in parallel. The main difference between transformer and reactor is a short-circuited secondary winding 84. It has two open loop portions arranged and connected to form one turn closed loop as shown in the FIG. 7. The number of turns in the secondary short-circuited winding, determining its reactance, is selected by design.

Figure 11:
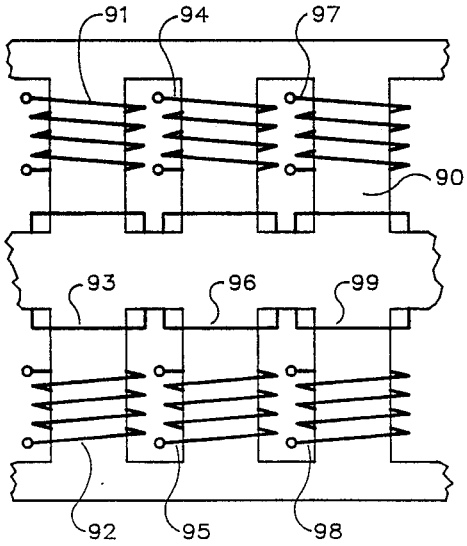
FIG. 11 is a diagram of a three phase reactor of the present invention showing windings arrangement and core configuration.

The three phase reactor is presented in the FIG. 11. The reactor symmetrical annular core 90 is shown unfolded. The core consists of three parallel rings tied-up by six legs arranged to form symmetrical three phase system. Every leg carries one primary and one open loop portion of the short-circuited secondary winding. Two linearly aligned core legs form one phase core carrying both windings primary and one compound secondary winding. So the primary windings 91, 92 and the secondary loop 93 form phase A. The primary windings 94, 95 and the secondary 96 complete phase B. And, finally, the phase C consists of primary windings 97, 98 and the secondary 99. The reactor, due to its core and the windings complete symmetry has minimum flux, current and voltage distortions typical for existing reactors.

The phenomena taking place at the every phase of the three phase reactor is analogous to the single phase transformer, reactor, presented in the FIG. 6, 7 and described above. The essential difference from the single phase reactor consists in utilization of the adjacent phase cores as yokes for closing magnetic circuits.

The single and polyphase primary windings of the present invention transformers, reactors are connected in parallel. The controlled semiconductor devices are included in phases of at least one set of primary windings to provide a relative phase and a magnitude shift of currents and fluxes linking each compound secondary phase winding. The preferred connection of primary windings with the control devices in single and three phase combination are presented in the following drawings and described thereafter.

Figure 12A:
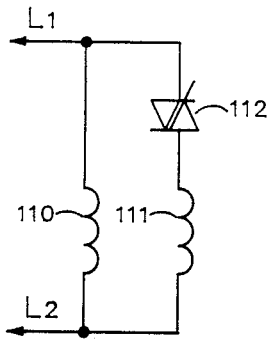
FIG. 12A through 12D are schematic diagrams showing primary coils of a single phase apparatus in accordance with the present invention which are interconnected with the gating devices and contacts in the winding circuits to smoothly effect control of operating characteristics.

The FIG. 12A shows primary windings 110, 111 of a single phase transformer, reactor connected in parallel with the line L1, L2. The winding 111 is connected in series with the triac 112 or with a couple of parallel reversed SCR's. When the triac, SCR's firing angle is varied from 0° to 180°, the secondary voltage of transformer drops down to 3 times for no-load and the secondary current drops down to 15 times for short circuit conditions. The reactor impedance changes up to 15 times, and these ranges may be further expanded by selecting magnetic circuit parameters.

Figure 12B:
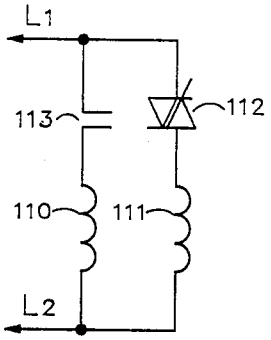

The FIG. 12B shows additional contact 113 in series with winding 110 that allows to expand the range of voltage control to 100% by adding a second zone of control. The open conditions of the contact 113 are equivalent to the non-conducting triac 112. The further reduction of the secondary voltage is accomplished through varying firing angle of triac 112 combined with the open contact 113.

Figure 12C:
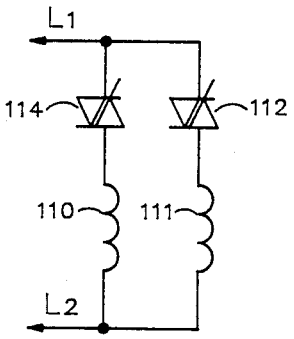

The FIG. 12C shows one more version of the single phase apparatus primary windings connection where contact is replaced by triac 114, covering smooth control of the second zone.

Figure 12D:
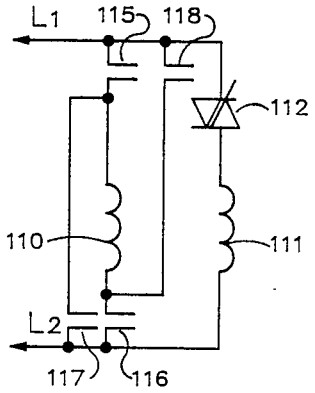

The FIG. 12D shows primary windings of single phase transformer, reactor with the provisions to reverse one of the primary windings, when the triac, SCR's are not conducting, and the output variable is at low limit of first zone of control. The opening of contacts 115, 116 and the closing of contacts 117, 118 reverse the current and the flux of winding 110. Now, the variation of triac 112 firing angle from 180° to 0° results in further reduction of a transformer secondary voltage or in an increase of a reactor impedance, thus departing from the flux distribution pattern shown in FIG. 9 and approaching to the flux pattern shown in the FIG. 10.

Figure 13A:
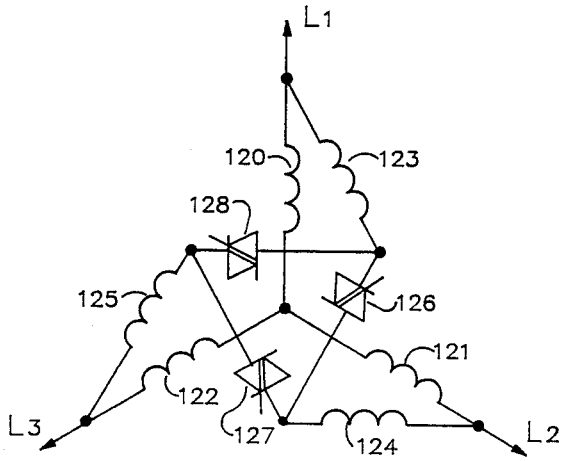
FIG. 13A through 13C are schematic diagrams showing alternate connection of polyphase apparatus primary coils in accordance with the present invention, where primary coils are interconnected with the gating devices and contacts in the winding circuits to smoothly effect control of the operating characteristics.

The FIG. 13A shows three phase version of single zone control transformer, reactor. The wye connected phase windings 120, 121, 122 form the first set of primary windings. The second set of primary windings is formed of phase windings 123, 124, 125 which wye connection is complete through triacs 126, 127 128 included between phase windings. the firing angle of the triacs determines the secondary voltage of the transformer or the impedance of the reactor.

Figure 13B:
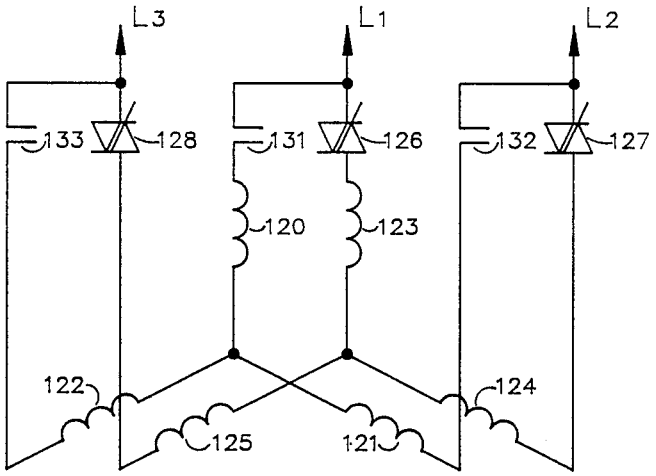

The two zone control for three phase apparatus is shown in the FIG. 13B. The first zone output parameters adjustment are made through the triacs 126, 127, 128 firing angle variation. The second zone of control is introduced when contacts 131, 132, 133 deenergize the wye connected second set of primary windings. The further voltage reduction or the impedance increase is achieved through the varying firing angles of the triacs.

Figure 13C:
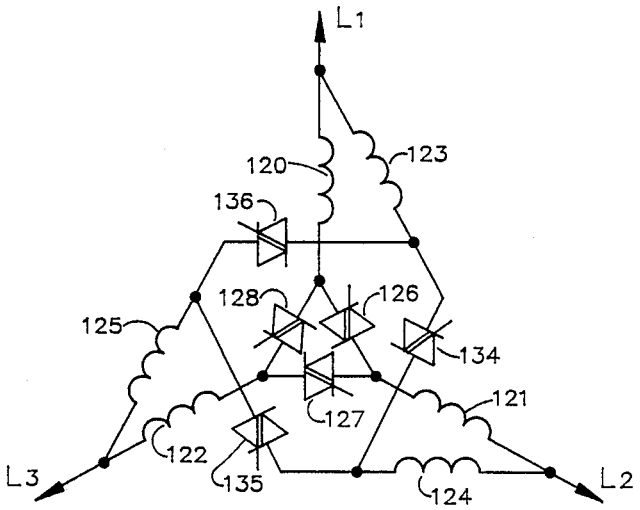

The FIG. 13C shows the primary windings connection and control of a three phase transformer, reactor with two zones of full range control. The first zone of control is provided through varying firing angle of triacs 126, 127, 128 included in the wye connection of the primary windings set 120, 121, 122. The second zone of control is realized through the varying firing angle of triacs 134, 135, 136 closing a wye formed by the second set of primary windings 123, 124, 125.

Figure 14:
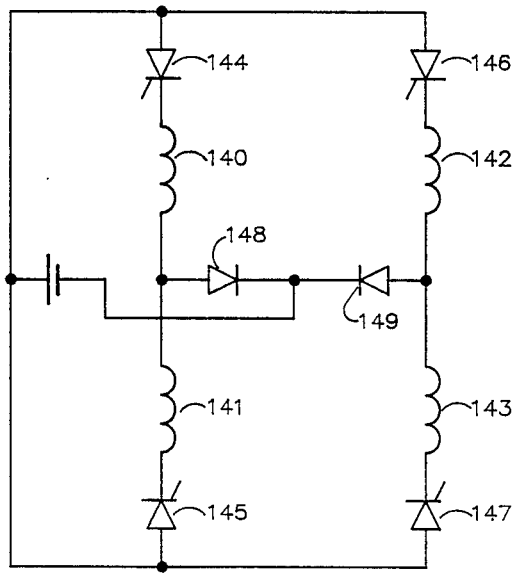
FIG. 14 is a schematic diagram of a single phase center tap primary coil transformer in accordance with the present invention where primary windings are interconnected with the gating devices in the winding circuits to smoothly effect control of the operating characteristics.

The connection and control of primary windings of the transformer for invertors and frequency convertors, according to this invention, is shown in the FIG. 14. The transformer has two double leg center tap primary windings with SCR included in each winding legs. The first primary winding consists of a leg 140 with SCR 144 and a leg 141 with SCR 145. The diode 148 is included between the center tap and the ground. The second primary winding consists of a leg 142 with SCR 146 and a leg 143 with SCR 147. The diode 149 is included between center tap and the ground.

The apparatus aquires additional attributes, in comparison with the existing transformers, for the switching mode devices providing a voltage control for the fixed frequency and the waveform modification.

The voltage control is accomplished by relative shift of equal width current pulses through the associated in pairs legs of primary windings 140, 142 and 141, 143, The conducting times of all four SCR's are equal. However, the firing of SCR 144 is shifted in time relatively to SCR 146. Similarly, the firing of SCR 145 is equally shifted in relation to SCR 147. As a result, the trains of rectangular pulses in each primary winding have a relative phase shift, leading to the voltage reduction in the compound secondary winding.

The waveform control is accomplished through the compounding unequal width current pulses in the associated pairs of legs of the primary windings. The conducting times of SCR's, supplying every leg of one primary winding, are not equal. The conducting time of SCR 144 exceeds conducting time of SCR 145 located in the other leg of the very same primary winding. The conducting time of SCR 147 equally exceeds the conducting period of SCR 146 placed in the legs of other primary winding. Each primary winding carries a train of equally assymetrical width current pulses. These assymetrical pulses trains are synchronized in such a way that the associated in pairs legs of primary windings carry the unequal width current pulses, having a common axis of symmetry of both short and long pulses compounded by a common secondary coil. These two superimposed pulses form a wave approaching a sinusoid. The width ratio of both pulses is adjustible to the frequency of switching and the load inductance. This feature allows to maintain a low harmonics content under a variable load condintion and to reduce or eliminate chokes, reactors from the switching mode devices.

While there have been shown and described preferred embodiments, it is to be understood that various other adaptations and modifications may be made within the spirit and scope of the invention.

What is claimed is:

1. In a transformer, the combination comprising: core means combining at least two complete core elements with at least one core yoke common for both said core elements;

primary winding means including at least two phase sets of independently fed coils with each phase set having at least one coil wound in the direction opposite to the associated coil of other set, carried by symmetrical core legs of each said core elements and separated by said common yoke;

secondary winding means including at least one phase set having at least one coil with at least two coil portions wound in opposite direction, carried by said symmetrical core legs of each said core elements and separated by said common yoke;

means for applying power to said primary winding phase sets including means for selectively controlling the application of power to at least one said phase set relatively to the other for enabling control of one of the currents therein and phase shift of the currents therein relative to the other said phase set to control operating parameters of said transformer.

2. The combination according to claim 1 wherein said transformer is a three phase transformer having:

core means formed of at least two complete, at least three legs, cores having common yoke;

at least two sets of three phase primary coils associated in oppositely disposed pairs;

at least one secondary three phase winding with each phase coil having at least two oppositely disposed portions;

wherein said means for selectively controlling the application of power include control device means in circuit relation with at least one of said set of primary phase coils.

3. The combination according to claim 1 wherein said transformer is a single phase transformer having:

at least two primary oppositely disposed coils;

at least one secondary coil having at least two oppositely disposed portions separated by said common core yoke;

wherein said means for selectively controlling the application of power include control device means in circuit relation with at least one of said primary coils.

4. The combination according to claim 1 wherein said means for selectively controlling the application of power includes control device means in circuit relation with at least one of phase coils.

5. The combination according to claim 4 wherein said control device means includes at least one silicon controlled rectifier.

6. The combination according to claim 4 wherein said control device means includes at least one triac.

7. The combination according to claim 2 wherein said means for selectively controlling the application of power include controllable semiconductor device means in circuit relation with at least one of said primary phase coils set.

8. The combination according to claim 3 wherein said means for selectively controlling the application of power includes controllable semiconductor device means in circuit relation with at least one of primary coils.

9. The combination according to claim 2 wherein said control device means includes at least one silicon controlled rectifier.

10. The combination according to claim3 wherein said control device means includes at least one silicon controlled rectifier.

11. The combination according to claim 3 wherein said control device means includes at least one of a triac and a silicon contolled rectifier.

12. The combination according to claim 1 wherein each phase coil of associated in pairs said primary phase coils sets is an arrangement of two legs coil having at least one tap.

13. The combination according to claim 12 wherein said means for selectively controlling the application of power include control device means in circuit relation with each leg of each said two legs coil.

14. The combination according to claim 13 wherein said control device means includes silicon controlled rectifiers.

15. The combination according to claim 13 wherein said control device means include controllable semiconductor device means.

16. In a transformer, the combination comprising:

core means formed of at least two complete core elements with at least one, common for both said core elements, core yoke for carrying at least two independently established magnetic fluxes;

primary winding means including at least two phase sets of independently fed, oppositely disposed, carried by symmetrical core legs, and separated by said common yoke coils for independently establishing at least two magnetic fluxes;

secondary winding means including at least one phase set having at least one coil with at least two oppositely disposed portions, carried by said symmetrical core legs, and separated by said common yoke, wherein said coil compounds elecromotive forces induced in said coil portions linked by said fluxes;

means for applying power to said primary winding phase sets including (a) means for applying power to said at least one phase coil of one of said phase sets and (b) means for controlling the application of power to the other said, at least one, phase coil of the other said phase set for enabling control of at least one of (i) the current therein relative to the other said at least one phase coil and (ii) the phase shift of the current therein relative to the other said, at least one, phase coil for controlling the operating parameters of said transformer.

17. The combination of claim 16 wherein said transformer is a three phase transformer having:

a core formed of at least two complete, at least three legs, cores with common yoke;

at least two sets of three phase primary coils associated in oppositely disposed pairs;

at least one set of three phase secondary coils with each coil having at least two oppositely disposed portions installed adjacent to associated said primary phase coils;

wherein said means for selectively controlling the application of power include controllable semiconductor device means in circuit relation with at least one of said primary phase coils set.

18. The combination of claim 16 wherein said transformer is a single phase transformer having:

a core formed of at least two complete core elements with common yoke;

at least two primary oppositely disposed coils;

at least one secondary coil having at least two oppositely disposed portions installed adjacent to associated said primary coils;

wherein said means for selectively controlling the application of power include controllable semiconductor device means in circuit relation with at least one of said primary coils.

19. The combination according to claim 16 wherein each phase coil of associated in pairs primary phase coils sets includes at least two identically wound, connected in series, accessible common point coils forming two legs center tap coil arrangement.

20. A method for controlling the output parameters of a transformer comprising the steps of:

(a) independently establishing at least two magnetic fluxes in said transformer core carring at least two primary phase coils;

(b) linking said fluxes by at least one secondary phase coil having at least two portions;

(c) compounding by said secondary coil electromotive forces induced in said coil portions, linked by said fluxes;

(d) varying a sum of said electromotive forces by shifting a relative phase and a magnitude of said fluxes, and currents producing said fluxes;

(e) controlling said relative phase and magnitude of said currents by varying firing angle of controllable semiconductor devices installed in circuit relation with at least one of said primary phase coils.

21. In a reactor, the combination comprising:

core means formed of at least two complete core elements with at least one, common for both said core elements, core yoke for carrying at least two independently established magnetic fluxes;

primary winding means including at least two phase sets of independently fed, oppositely disposed, carried by symmetrical core legs, separated by said common yoke coils for independently establishing at least two magnetic fluxes;

secondary winding means including at least one phase set having at least one short-circuited coil with at least two oppositely disposed portions, carried by said symmetrical core legs, and separated by said common yoke, wherein said coil compounds elecromotive forces induced in said coil portions linked by said fluxes;

means for applying power to said primary winding phase sets including (a) means for applying power to said at least one phase coil of one of said phase sets and (b) means for controlling the application of power to the other said, at least one, phase coil of the other said phase set for enabling control of at least one of (i) the current therein relative to the other said at least one phase coil and (ii) the phase shift of the current therein relative to the other said, at least one, phase coil for controlling the operating parameters of said reactor.

22. The combination of claim 21 wherein said reactor is a three phase reactor having:

a core formed of at least two complete, at least three legs, cores with common yoke;

at least two sets of three phase primary coils associated in oppositely disposed pairs;

at least one set of three phase secondary short-circuited coils with each coil having at least two oppositely disposed portions installed adjacent to associated said primary phase coils;

wherein said means for selectively controlling the application of power include controllable semiconductor device means in circuit relation with at least one of said primary phase coils set.

23. The combination according to claim 22 wherein said each short-cicuited phase coil of said secondary winding means is a single turn coil.

24. The combination of claim 21 wherein said reactor is a single phase reactor having:

a core formed of at least two complete core elements with common yoke;

at least two primary oppositely disposed coils;

at least one secondary short-circuited coil having at least two oppositely disposed portions installed adjacent to associated said primary coils;

wherein said means for selectively controlling the application of power include controllable semiconductor device means in circuit relation with at least one of said primary coils.

25. The combination according to claim 24 wherein said secondary short-circuited coil is a single turn coil.

26. A method for controlling the impedance of a reactor comprising the steps of:

(a) independently establishing at least two magnetic fluxes in said reactor core carring at least two primary phase coils;

(b) linking said fluxes by at least one secondary short-circuited phase coil having at least two portions;

(c) compounding by said secondary coil electromotive forces induced in said coil portions, linked by said fluxes;

(d) varying a sum of said electromotive forces by shifting a relative phase and a magnitude of said fluxes, and currents producing said fluxes;

(e) controlling said relative phase and magnitude of said currents by varying firing angle of controllable semiconductor devices installed in circuit relation with at least one of said primary phase coils.

27. In a reactor, the combination comprising:

core means combining at least two complete core elements with at least one core yoke common for both said core elements;

primary winding means including at least two phase sets of independently fed coils with each phase set having at least one coil wound in direction opposite to the coil of other set and carried by symmetrical core legs separated by said common yoke;

secondary winding means including at least one phase short-circuited coil having at least two coil portions wound in opposite direction, carried by symmetrical core legs of each core element and separated by said common yoke;

means for applying power to said primary winding phase sets including means for selectively controlling the application of power to at least one said set relatively to the other for enabling control of one of the current therein and phase shift of the current therein relative to the other said phase set to control operating parameters of said reactor.

28. The combination according to claim 27 wherein said reactor is a three phase reactor having:

at least two sets of three phase primary coils associated in pairs;

at least one three phase secondary winding with each short-circuited phase coil having two portions;

means for selectively contolling the application of power including control device means in circuit relation with at least one of said sets.

29. The combination according to claim 27 wherein said reactor is a single phase reactor having;

at least two primary windings associated in pairs;

at least one short-circuited secondary winding with two portions;

wherein said means for selectively controlling the application of power includes control device means in circuit relation with at least one of said primary windings.

30. The combination according to claim 28 wherein said secondary winding means includes at least three phase short circuited loop members having open loop portions carried by symmetrical core legs of each said core elements and separated by said common yoke.

31. The combination according to claim 29 wherein said secondary winding means includes at least one short-circuited loop member having open loop portions carried by symmetrical core legs of each said core elements and separeted by said common yoke.

32. The combination according to claim 27 wherein said means for selectively controlling the application of power includes control device means in circuit relation with at least one of phase coils.

33. The combination according to claim 32 wherein control device means includes at least one silicon controlled rectifier.

34. The combination according to claim 32 wherein said control devive means includes at least one triac.

35. The combination according to claim27 wherein said means for selectively controlling the application of power includes controllable semiconductor device means.

36. The combination according to claim 28 wherein said means for selectively controlling the application of power includes controllable device means in circuit relation with at least one of primary coils.

37. The combination according to claim 28 wherein said control device means includes at least one of a triac and a silicon controlled rectifier.

* * * * *